US009186885B2

(12) United States Patent
Boland et al.

(10) Patent No.: US 9,186,885 B2
(45) Date of Patent: Nov. 17, 2015

(54) ALIGNMENT OF PRINTHEADS IN PRINTING SYSTEMS

(71) Applicants: Stuart J. Boland, Denver, CO (US); Scott R. Johnson, Erie, CO (US); Casey E. Walker, Boulder, CO (US)

(72) Inventors: Stuart J. Boland, Denver, CO (US); Scott R. Johnson, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/522,455

(22) Filed: Oct. 23, 2014

(65) Prior Publication Data

US 2015/0290931 A1 Oct. 15, 2015

Related U.S. Application Data

(63) Continuation-in-part of application No. 13/933,582, filed on Jul. 2, 2013, now Pat. No. 9,028,027.

(51) Int. Cl.

| | |
|---|---|
| ***B41J 29/38*** | (2006.01) |
| ***B41J 2/045*** | (2006.01) |
| ***B41J 11/00*** | (2006.01) |
| ***B41J 11/46*** | (2006.01) |
| ***B41J 2/21*** | (2006.01) |
| ***B41J 15/04*** | (2006.01) |
| ***B41J 25/00*** | (2006.01) |

(52) U.S. Cl.

CPC ..... *B41J 2/04505* (2013.01); *B41J 2/2146* (2013.01); *B41J 11/0095* (2013.01); *B41J 11/46* (2013.01); *B41J 15/046* (2013.01); *B41J 25/001* (2013.01)

(58) Field of Classification Search

CPC ..... B41J 2/04505; B41J 2/04558; B41J 2/04556; B41J 2/2146; B41J 11/0045; B41J 11/0055; B41J 11/008; B41J 11/20; B41J 11/46; B41J 11/0095; B41J 15/046; B41J 25/001

See application file for complete search history.

(56) References Cited

U.S. PATENT DOCUMENTS

| | | | |
|---|---|---|---|
| 4,572,417 | A | 2/1986 | Joseph et al. |
| 6,701,837 | B2 | 3/2004 | Ohba et al. |
| 6,989,853 | B2 | 1/2006 | Ream et al. |
| 7,798,587 | B2 | 9/2010 | Mizes et al. |

(Continued)

FOREIGN PATENT DOCUMENTS

| | | |
|---|---|---|
| WO | WO2011134487 | 11/2011 |

OTHER PUBLICATIONS

Bell et al., U.S. Appl. No. 13/933,582, 'Alignment of Printheads in Printing Systems', filed May 29, 2014.

*Primary Examiner* — Juanita D Jackson

(74) *Attorney, Agent, or Firm* — Duft Bornsen & Fettig LLP

(57) ABSTRACT

Systems and methods are provided for aligning printheads of a printing system. One embodiment is a system for aligning printheads of a printing system. The system includes a first sensor configured to detect lateral positions of an upstream printhead relative to sections of a web of print media traveling through the printing system, and a second sensor configured to detect lateral positions of a downstream printhead relative to the sections of the web. The downstream printhead is placed after the upstream printhead in the direction of travel of the web. The system also includes a controller configured to align the downstream printhead with the sections of the web based on the lateral positions of the upstream printhead and the lateral positions of the downstream printhead.

30 Claims, 8 Drawing Sheets

(56) References Cited

U.S. PATENT DOCUMENTS

| | | | | |
|---|---|---|---|---|
| 8,075,080 | B2 | 12/2011 | Albertalli | |
| 8,075,086 | B2 * | 12/2011 | Mizes | B41J 3/543 347/19 |
| 8,270,024 | B2 | 9/2012 | Brown et al. | |
| 8,328,315 | B2 | 12/2012 | Eun et al. | |
| 8,419,144 | B2 | 4/2013 | Castillo et al. | |
| 2012/0223996 | A1 | 9/2012 | Ernst et al. | |
| 2013/0050314 | A1 | 2/2013 | Duke et al. | |

* cited by examiner

ALIGNMENT OF PRINTHEADS IN PRINTING SYSTEMS

This application is a CIP of U.S. patent application Ser. No. 13/933,582, titled "ALIGNMENT OF PRINTHEADS IN PRINTING SYSTEMS," filed on Jul. 7, 2013, now U.S. Pat. No. 9,028,027, and herein incorporated by reference.

FIELD OF THE INVENTION

The invention relates to the field of printing systems, and in particular, to alignment of printheads in continuous-forms printing systems.

BACKGROUND

Entities with substantial printing demands typically use a production printer. A production printer is a high-speed printer used for volume printing (e.g., one hundred pages per minute or more). Production printers include continuous-forms printers that print on a web of print media stored on a large roll.

A production printer typically includes a localized print controller that controls the overall operation of the printing system, and a print engine (sometimes referred to as an "imaging engine" or a "marking engine"). The print engine includes one or more printhead assemblies, with each assembly including a printhead controller and a printhead (or array of printheads). An individual printhead includes multiple (e.g., hundreds of) tiny nozzles that are operable to discharge ink as controlled by the printhead controller. A printhead array is formed from multiple printheads that are spaced in series across the width of the web of print media.

While printing, the web is quickly passed underneath the nozzles, which discharge ink at intervals to form pixels on the web. In order to ensure that the web is consistently positioned underneath the nozzles, steering systems may align the web laterally with respect to its direction of travel. Steering systems may be calibrated when the printer is first installed. However, even when the web is ostensibly aligned, fluctuations in the physical properties of the web itself (e.g., small micron-level variations along the edge of the web, lateral tension variation along the web, orientation of the fibers in the web, etc.) may cause the web to experience lateral shifts during printing. Even though the individual shifts may be small (e.g., on the order of microns), the shifts reduce print quality. For example, when multiple printheads are used by a printer to form a mixed color pixel, a small fluctuation in web position may cause an upstream printhead to mark the correct physical location on the web, while a downstream printhead marks the wrong physical location on the web. This distorts the final color of the pixel in the printed job.

SUMMARY

Embodiments described herein determine the lateral position of an upstream printhead with respect to a web of print media, and align one or more downstream printheads with the lateral position of the upstream printhead. These systems and methods may further dynamically align the one or more downstream printheads to account for fluctuations in lateral position of the upstream printhead that occur while a job is printing.

One embodiment is a system for aligning printheads of a continuous-forms printing system. The system includes a first sensor configured to detect lateral positions of an upstream printhead relative to sections of a web of print media traveling through the printing system, and a second sensor configured to detect lateral positions of a downstream printhead relative to the sections of the web. The downstream printhead is placed after the upstream printhead in the direction of travel of the web. The system also includes a controller configured to align the downstream printhead with the sections of the web based on the lateral positions of the upstream printhead and the lateral positions of the downstream printhead.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
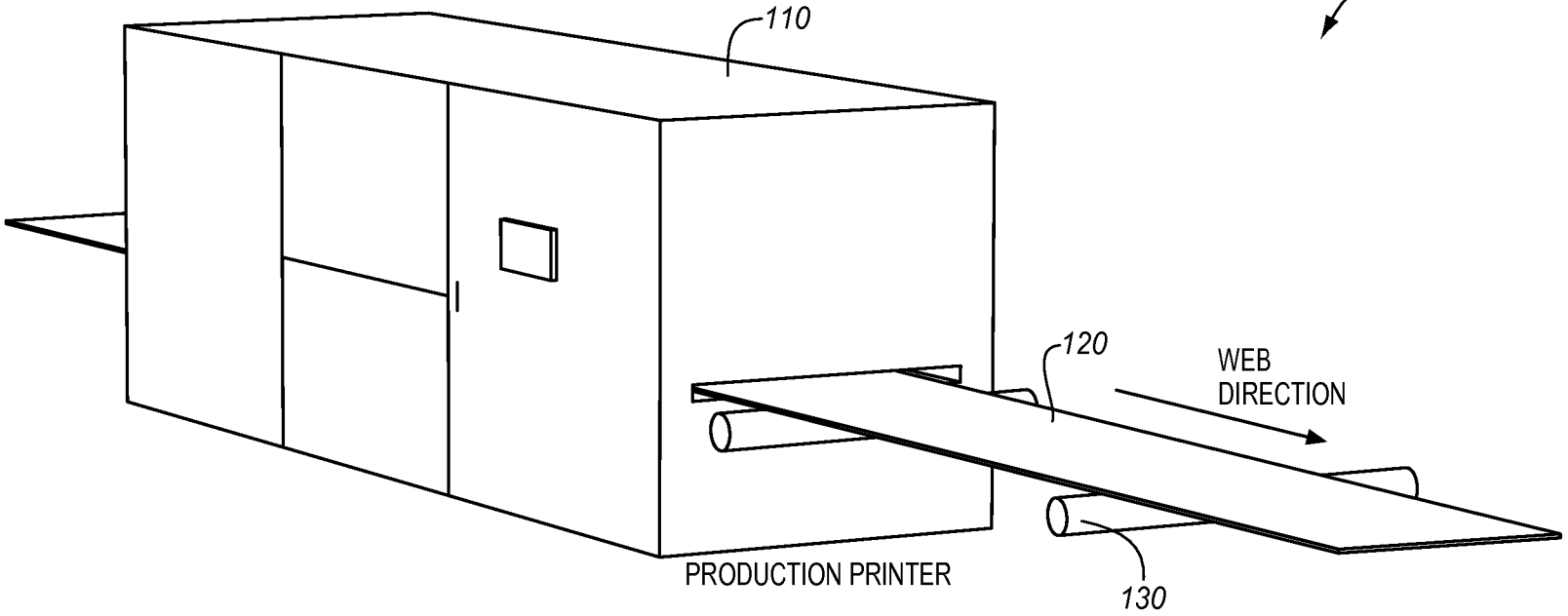
FIG. 1 illustrates an exemplary continuous-forms printing system.

FIG. 1 illustrates an exemplary continuous-forms printing system 100. Printing system 100 includes production printer 110, which is able to apply ink onto a web of continuous-forms print media 120 (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), and Key (K) black inks. One or more rollers 130 position and tension web 120 as it travels through printing system 100.

Figure 2:
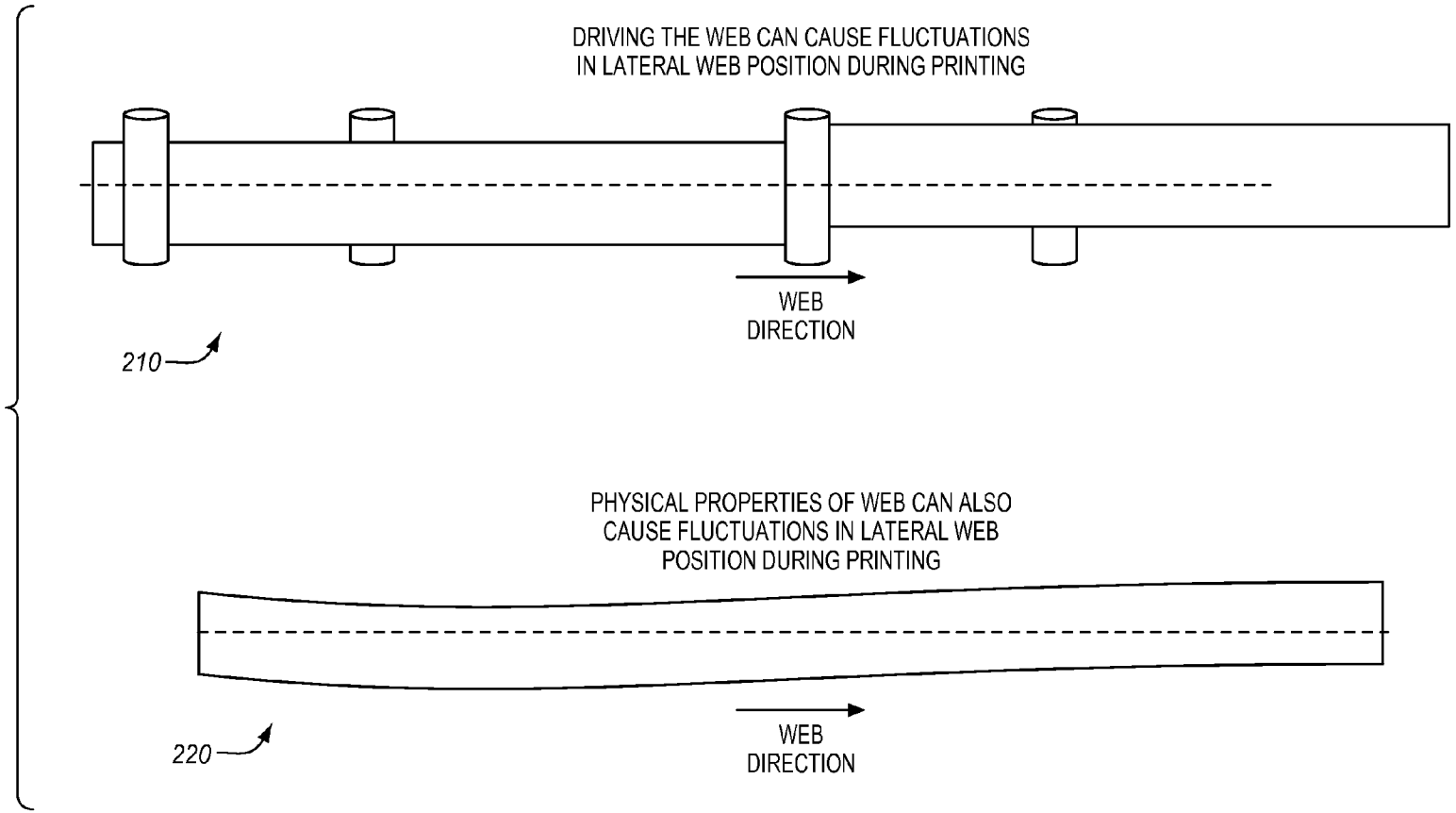
FIG. 2 illustrates how a web of print media may oscillate laterally within the printing system of FIG. 1 during printing.

FIG. 2 illustrates how a web of print media may shift laterally within the exemplary printing system 100 of FIG. 1 during printing. For example, FIG. 2 at element 210 illustrates that rollers may impart lateral shifts to a web of print media. As used herein, a lateral shift is a positional change that is within the plane of the web and orthogonal to the direction of travel of the web (i.e., orthogonal to the length of the web, and parallel to the width of the web).

As shown in element 210, before traveling through a roller the lateral position of the centerline of the web (with respect to the web's direction of travel as shown on FIG. 2) is below the dashed reference line. After traveling through the roller, the centerline is above the reference line. Furthermore, the degree of lateral shifting imparted by printing system 100 itself may oscillate in amplitude and direction while printing system 100 is operating. In short, the very act of driving the web may cause the web to laterally oscillate back and forth. Static adjustments do not compensate for these oscillating lateral shifts that occur during printing.

FIG. 2 at element 220 shows that the web itself may also contribute to lateral fluctuations. Element 220 shows that a web may have an uneven edge. For example, some webs of print media are initially cut with a blade. When a long cut is being made, the blade itself may oscillate laterally back and forth at a certain frequency by very small amounts (e.g., a few microns). This in turn imparts an uneven edge to the web. Since many printheads maintain the same absolute position while printing, the distance of printed marks relative to the edge of the paper will vary as the edge of the paper itself varies.

Figure 3:
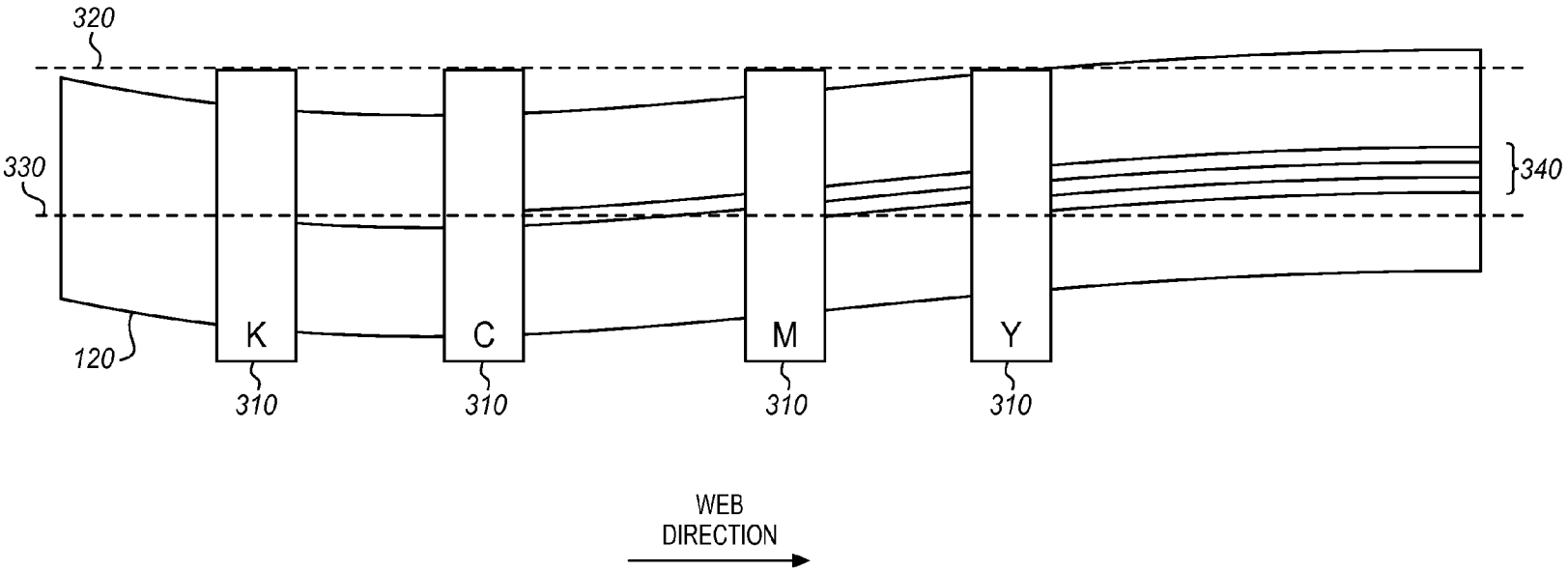
FIG. 3 is a diagram illustrating exemplary problems resulting from lateral web oscillations in a printing system that uses multiple color planes.

FIG. 3 is a diagram illustrating exemplary problems resulting from lateral web oscillations in a printing system that uses multiple color planes that are physically separated from each other. In this case, each printhead array 310 acts as a color plane for one of cyan, magenta, yellow, and key black. In FIG. 3, each printhead array 310 is aligned to the same absolute lateral position relative to its peers, as indicated by reference lines 320 and 330. When the printheads are aligned in this manner, they will all mark the same absolute lateral positions with respect to each other. However, because the position of web 120 fluctuates in between the printheads, ink marked by each printhead array 310 appears on a different lateral position on web 120, as shown by element 340. Thus, color plane separation occurs even though each of printheads 310 is marking the same absolute lateral position. This problem is particularly undesirable because the color of a single pixel on a page is often defined by multiple colors of marking fluid applied by printhead arrays at different locations. Thus, if a color plane is misaligned on the web with respect to another color plane, the colors of individual pixels may be inaccurate, resulting in a highly noticeable degradation of print quality.

Figure 4:
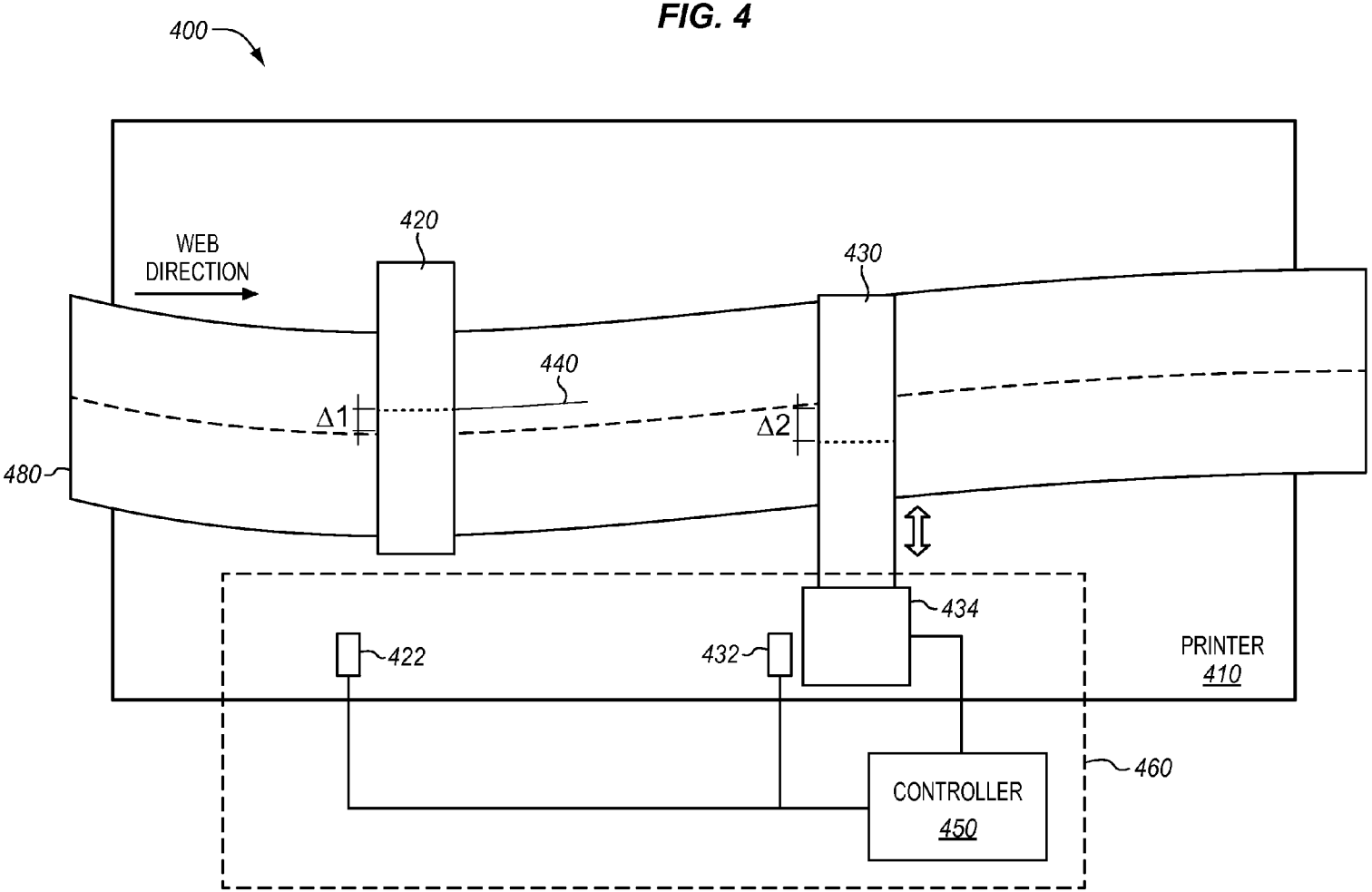
FIG. 4 is a diagram illustrating a printing system that aligns printheads in an exemplary embodiment.

To address these problems with printhead alignment, FIG. 4 illustrates a printing system 400 that aligns printheads in an exemplary embodiment. Printing system 400 comprises any system, component, or device operable to mark a web of print media. Printing system 400 has been enhanced to adjust the lateral position of printhead 430. These adjustments are made in order to align printhead 430 with the lateral position of printhead 420 at web 480. For example, if printhead 420 marks a section of web 480 at a lateral position with respect to web 480, controller 450 may align printhead 430 to mark the same section of web 480 at the same lateral position when that section reaches printhead 430. As used herein, because a section of traveling web will reach printhead 420 before it reaches printhead 430, printhead 420 is considered "upstream" of printhead 430, and printhead 430 is considered "downstream" of printhead 420. Furthermore, as used herein a "section" of a web is a part of the web that extends across the width of the web, but has a limited length in the direction of travel of the web. For example, a section of the web may comprise a single page, a single line of pixels on a page, multiple printed pages, etc.

In this embodiment, printing system 400 includes printer 410, which uses printheads 420 and 430 to mark ink onto web 480. Printing system 400 also includes a printhead alignment system 460 (indicated by the dashed line), which is made up of controller 450, sensors 422 and 432, and a positioning system 434 for printhead 430. Sensor 422 detects the lateral position of printhead 420 with respect to web 480, and sensor 432 detects the lateral position of printhead 430 with respect to web 480. Controller 450 then adjusts the lateral position of printhead 430 (e.g., during printing) to compensate for the changing position of printhead 420 on web 480. Due to natural and dynamic variations in web 480 and the rollers that position web 480, the lateral position of printhead 420 may change with respect to web 480 even in embodiments where printhead 420 is kept at a fixed location within printer 410.

Sensors 422 and 432 comprise any systems, components, or devices operable to detect positional shifts of a printhead with respect to web 480. For example, a sensor may comprise a laser, pneumatic, photoelectric, ultrasonic, infrared, optical, or any other suitable type of sensing device. Furthermore, each sensor may be placed upstream (e.g., less than one foot upstream) of its corresponding printhead. In this embodiment, each sensor detects the position of physical edge of the web. In another embodiment, sensors are placed downstream of their corresponding printheads in order to detect the positions of marks made by the printheads onto the web. These measurements may then be used to determine the lateral position of each printhead relative to sections of web 480 as the sections travel between the printheads.

Controller 450 comprises any system, component, or device operable to control the position of printhead 430, based on changes in the lateral position of printhead 420 with respect to web 480 as detected by sensor 422. For example, controller 450 may direct a positioning device 434 (e.g., a linear actuator) to physically move printhead 430 to account for changes in the lateral position of printhead 420. Controller 450 may be implemented, for example, as custom circuitry, as a processor executing programmed instructions, etc. Controller 450 may be integrated into printer 410 or separate from printer 410 as desired. Positioning device 434 may comprise a linear actuator, a movable printhead assembly that repositions itself by driving itself along a fixed rail, or any other suitable system capable of moving printhead 430.

As shown in FIG. 4, marks 440 made by printhead 420 may deviate by some amount $\Delta 1$ from their intended locations on web 480. Meanwhile, printhead 430 may deviate by a different amount $\Delta 2$, and these amounts may be constantly varying as printing continues owing to oscillations in web 480. Thus, the difference in lateral position between printhead 420 and printhead 430 may continually vary.

Figure 5:
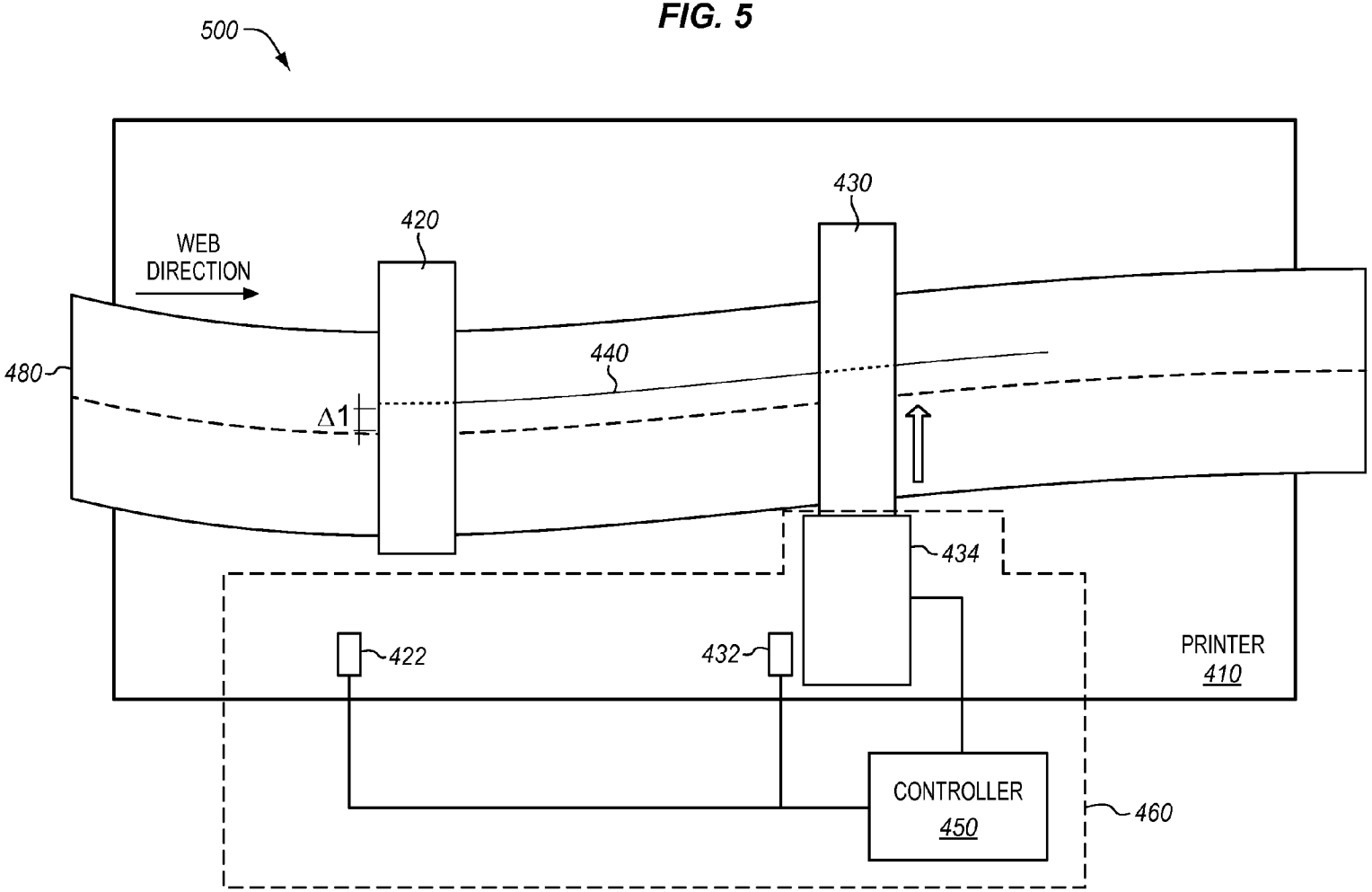
FIG. 5 is a diagram illustrating the printing system of FIG. 4 aligning a printhead in an exemplary embodiment.

FIG. 5 is a further diagram 500 illustrating printing system 400 of FIG. 4 aligning a printhead in an exemplary embodiment. Specifically, FIG. 5 illustrates a scenario where printhead 430 has been moved to align with/match the lateral position of printhead 420 with respect to a section of web 480. As shown in FIG. 5, printhead 430 has been moved so that its centerline (indicated by a dotted line) is aligned on the page at the same location occupied by the centerline of printhead 420 when printhead 420 marked that section of web 480.

Illustrative details of the operation of printing system 400 will be discussed with regard to FIG. 6. Assume, for this embodiment, that printer 410 has started printing, and that during printing web 480 is being driven underneath printheads 420 and 430. Further, assume that the lateral position of printhead 420 with respect to web 480 is shifting back and forth due to the web being driven.

Figure 6:
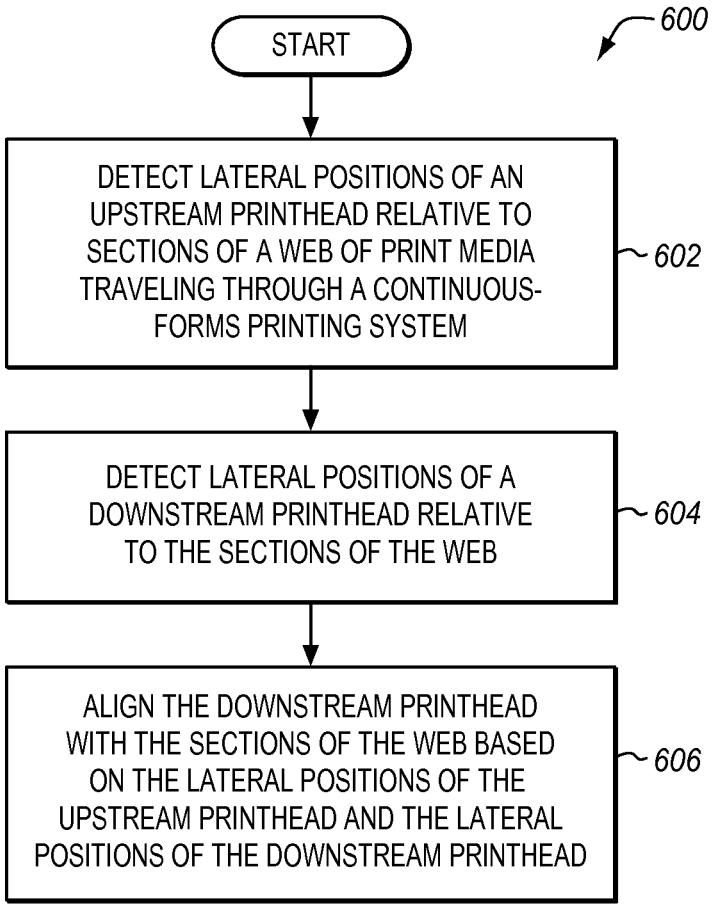
FIG. 6 is a flowchart illustrating a method of accounting for lateral shifts at a web of print media in an exemplary embodiment.

FIG. 6 is a flowchart illustrating a method 600 of accounting for lateral shifts at a web of print media in an exemplary embodiment. The steps of method 600 are described with reference to printing system 400 of FIG. 4, but those skilled in the art will appreciate that method 600 may be performed in other systems. The steps of the flowcharts described herein are not all inclusive and may include other steps not shown. The steps described herein may also be performed in an alternative order.

In this embodiment, sensors 422 and 432 continuously measure the lateral position of printheads 420 and 430 with respect to web 480. Specifically, sensor 422 measures a distance to an edge of web 480 proximate to printhead 420, and sensor 432 measures a distance to an edge of web 480 proximate to printhead 430. In step 602, controller 450 operates sensor 422 to detect lateral positions of printhead 420 relative to sections of web 480 that pass across printhead 420. Similarly, in step 604 controller 450 operates sensor 432 to detect lateral positions of printhead 430 relative to sections of web 480 that pass across printhead 430. Controller 450 may further process sensor data (e.g., indicating edge position) to determine the lateral position of printhead 420 relative to web 480 at a section of web 480. Determining the lateral position of printhead 420 with respect to web 480 may include analyzing input from sensor 422 to determine an amount of offset of printhead 420 ($\Delta 1$) from a default lateral position with respect to web 480, such as an ideal (e.g., centered) marking position on web 480.

In step 606, controller 450 aligns printhead 430 with the sections of the web, based on the lateral positions of printhead 420 and the lateral positions of printhead 430. Thus, for a given section of web, controller 450 may align printhead 430 to the lateral position of printhead 420 for that section, by the time the section of the web reaches printhead 430. In one embodiment, this process includes acquiring a distance measurement from sensor 432 in order to determine an offset of printhead 430 ($\Delta 2$) before the section of web reaches printhead 430. Controller 450 determines an amount of adjustment to move printhead 430 from its current lateral position to align printhead 430 with the section of the web, and instructs positioning device 434 to adjust the lateral position of printhead 430 by the time that the section of the web has reached printhead 430. In this manner, controller 450 accounts for differences in relative lateral position between printhead 420 and printhead 430 for individual sections of web 480. Thus, if controller 450 determines that printhead 420 is shifted in one direction in relation to a section of web by fifty microns, then it may direct positioning device 434 to move printhead 430 so that it will be shifted upward by fifty microns with respect to web 480 when the section of web 480 reaches printhead 430.

Controller 450 may also time its adjustments based on speed and/or distance metrics, such as the distance between sensor 422 and printhead 430, the distance between sensor 432 and printhead 430, the distance between printhead 420 and printhead 430, etc. When the speed of web 480 is known, a lag time between the components of printer 410 may be determined to ensure that adjustments to printhead 430 are properly timed. For example, if sensor 422 is positioned one and a half seconds upstream of printhead 430, controller 450 may implement a lag time to ensure that printhead 430 has moved to its new position after one and a half seconds (e.g., by implementing an input delay for an actuator driving printhead 430).

Method 600 provides a substantial benefit over prior techniques, because it accounts for web 480 shifting between printhead 420 and printhead 430. Specifically, instead of considering the absolute lateral position of printheads 420 and 430 within printer 410, method 600 determines the lateral position of printheads 420 and 430 with respect to web 480 (which may be unpredictably oscillating). This allows printhead 430 to be repositioned accurately on web 480 to the same relative lateral position as printhead 420, ensuring that both printheads are aligned in the same way with respect to the web when they print. These techniques substantially eliminate issues arising from misaligned color planes, because these techniques may be used to ensure that marking materials for colors are aligned when dispensed onto the web to create combined colors at pixel locations.

Method 600 may repeat iteratively/continuously during printing so that lateral shifts of printhead 420 with respect to web 480 are consistently identified and addressed. This allows printing system 400 to dynamically account for lateral movement at the web during printing, even when the lateral movement of the web is unpredictable. Better positioning of printheads with respect to the web ensures greater print quality, and in systems that use multiple colors of ink, it also helps to ensure that printed colors are accurately marked onto the print media.

In a further embodiment, controller 450 may receive input from each sensor indicating a stream of lateral positions, and may apply a lowpass filter to one or more input streams before attempting to correct shifts in the position of the web. A lowpass filter (in, for example, the 5 Hertz (Hz) range) may help prevent controller 450 from responding to high-frequency noise when repositioning/aligning printhead 430.

In another embodiment, controller 420 may identify an acceleration limit for printhead 430 when printhead 430 is being repositioned. Controller 420 then keeps printhead 430 from exceeding the defined limit. If printhead 430 is accelerated too quickly when it is being moved, the original momentum of printhead 430 may cause it to overshoot its intended final location. This in turn may cause positioning errors at printhead 430 when printhead 430 overshoots its target location.

In another embodiment, controller 450 identifies a limit for a speed of printhead 430 when printhead 430 is being repositioned. Controller 450 then keeps printhead 430 from exceeding the defined velocity limit. This may be beneficial, for example, in embodiments where printhead 430 is made up of multiple rows of nozzles that are each located upstream/downstream from each other with respect to the direction of travel of the web. After printing, the ink from the rows of nozzles should be evenly distributed. However, if the entire printhead is moved too quickly laterally across the web, each row of the printhead may print at a different location than intended. In short, when the speed of the printhead is substantial and the printhead is printing while it is being repositioned, each row could mark a different lateral position on the web than intended. A speed limit for a printhead addresses this problem.

In yet another embodiment, an amount of mechanical slop may exist in the printing system known as "backlash." Backlash introduces an absolute position error when an actuator/motor is instructed to drive a printhead a specific distance. This effect may be amplified when the actuator/motor is instructed to change the direction of motion of the printhead. For example, if a linear actuator is instructed to drive a moving printhead thirty five microns in the opposite direction, mechanical deflection/deformation issues, slip issues, and clearance discrepancies may cause the printhead to be moved only twenty microns in the intended direction.

Controller 450 may compensate for backlash based on known correlations between driving instructions (e.g., "move the printhead thirty five microns") and the actual motion of a printhead. For example, backlash may occur predictably using a formula that is found for the printer based on regression techniques used on measured data. In a further example, amounts of backlash may be individually measured, stored in memory, and compensated for. Amounts of backlash may be stored in multiple tables, where one table describes backlash occurring when there is no change in direction, and another table describes backlash occurring when there is a change in direction. A backlash table may include, for example, a series of entries each indicating a relationship between a driving instruction and an actual distance traveled by the printhead. Using these tables, controller 450 is capable of determining discrepancies between input directing a linear actuator/motor to move a printhead a certain distance, and actual motion of the downstream printhead. Controller 450 is then able to adjust the input to the linear actuator based on the discrepancies.

In a further embodiment, controller 450 identifies a resonant frequency of printing system 400. A resonant frequency of printing system 400 is a frequency of motion that amplifies the vibration that naturally occurs within printing system 400 during printing. Resonant vibrations at printing system 400 may cause damage to its components. This resonant frequency may be determined based on actual measurements of printing system 400 during printing operations, or may be a predetermined value.

After controller 450 determines the resonant frequencies of printing system 400 (e.g., by consulting values stored in memory), controller 450 may take measures to keep from increasing resonant vibrations at printing system 400 when it moves one or more printheads back and forth. To this end, controller 450 may apply a stopband filter to input from sensor 430, in order to stop from measuring (and therefore attempting to correct) vibrations of printing system 400 that occur at the resonant frequency. This may be desirable, as correcting for motions of the web at resonant frequencies may in some cases increase vibrations at printing system 400 and damage it. However, in some embodiments a stopband filter is not applied, meaning that corrections for vibrations at the natural frequency of the printing system may be applied.

In a further embodiment, multiple printheads (each accompanied by a sensor) are aligned based on the determined lateral positions of upstream printheads. This may even include printheads in entirely different printers that print onto the same web. Each downstream printhead may, for example, adjust its lateral position based on the nearest upstream printhead in the printing system, the most upstream printhead in the printing system, etc. In a further embodiment, each printhead of the printing system is a part of an entire color plane, and each color plane is upstream/downstream from the other.

In further embodiments, each printhead may make one or more gutter marks for reference by the other printheads, placed at a known lateral position with respect to that printhead. The locations of these marks may be detected by sensors in order to determine the lateral positions of upstream printers. Alternatively, an independent system may apply a gutter mark, such as an ultraviolet or thermal gutter mark invisible to the naked eye.

EXAMPLES

In the following examples, additional processes, systems, and methods are described in the context of a printing system that adjusts printhead position with respect to a web of print media during printing.

Figure 7:
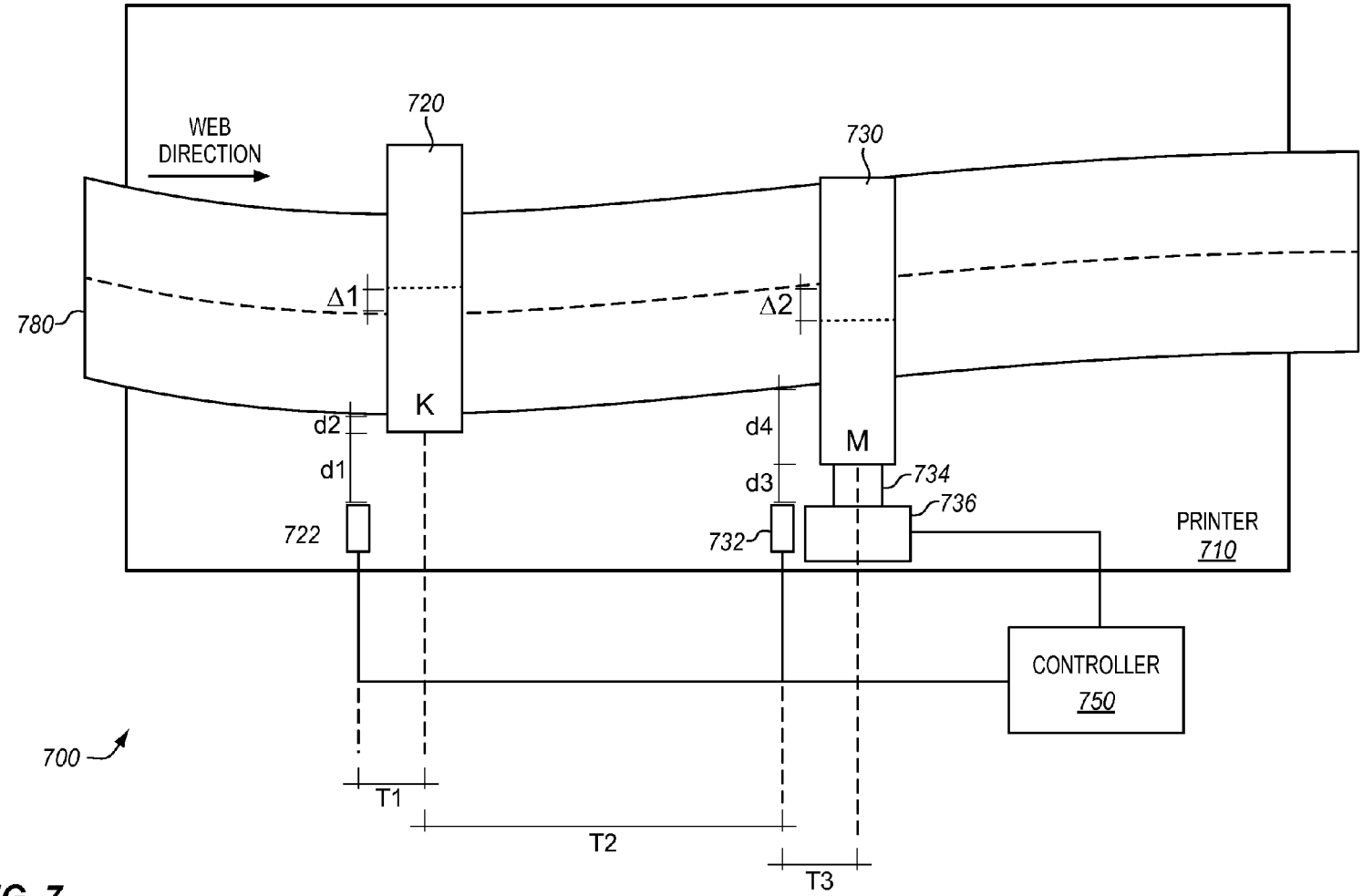
FIG. 7 is a diagram further illustrating a printer of a multi-printer printing system that dynamically aligns printheads in an exemplary embodiment.

FIG. 7 is a block diagram 700 illustrating a further exemplary printing system that accounts for lateral shifts at a web of print media 780. In this embodiment, the printing system includes two inkjet printers used to print incoming jobs. Each printer includes two printhead arrays, and each printhead array is used as a color plane to mark a different color of ink onto web 780 of print media. The upstream printer 710 marks black (K) and magenta (M) ink onto web 780, while the downstream printer (not shown) marks cyan (C) and yellow (Y) ink onto web 780.

While a job is being printed, web 780 travels through the printing system at a rate of eight linear feet per second, and the lateral position of web 780 fluctuates back and forth, even between individual color planes. The printing system aligns the C, M, and Y color planes to match lateral positions detected for the K color plane at web 780. Specifically, controller 750 moves the C, M, and Y color planes to compensate for errors in lateral position that are between about five microns and several hundred microns, occurring at a rate of about 0.1 to 2 Hertz (Hz). In order to calibrate the corrections made by the various printhead arrays, the lateral position of furthest upstream printhead array 720 (here, the printhead array responsible for the black (K) color plane) is detected by a laser thru-beam sensor 722. Printhead array 720 is fixed within printer 710, but because web 780 moves laterally during printing, the lateral position of printhead array 720 with regard to an edge of web 780 varies over time.

Sensors 722 and 732 continuously measure the lateral position of printheads 720 and 730 with respect to web 780. In this embodiment, sensor 722 measures a distance to an edge of web 780. This measured distance is equal to d1+d2. As used herein, d1 corresponds with the expected distance to an edge of web 780 when printhead array 720 is perfectly laterally positioned with respect to web 780. Meanwhile, d2 corresponds with an offset value indicating an amount of lateral deviation of printhead array 720 from its expected position with respect to web 780. When printhead array 720 is fixed or when the absolute position of printhead array 720 with respect to sensor 722 is otherwise known, d1 becomes a known value, which means that d2 may be determined.

Sensor 732 also measures a distance to an edge of web 780. This measured distance is equal to d3+d4. As used herein, d3 corresponds to the expected distance to an edge of a perfectly aligned web 780 based on the current absolute position of printhead array 730 within printer 410. Meanwhile, d4 corresponds with an offset value indicating an amount of lateral deviation of printhead array 730 from d3. When the absolute position of printhead array 730 with respect to sensor 732 is known, d3 becomes a known value, which means that d4 may be determined.

Controller 750 also receives input indicating a speed at which web 780 is traveling. The input may, for example, come from printer 710, or from an encoder device that is physically distinct from printer 710. Based on the speed and known distances between the various sensors and printhead arrays of the printing system, controller 750 determines a time T1 for a section of the web to travel from sensor 722 to printhead array 720, a time T2 for the section of the web to travel from printhead array 720 to sensor 732, and a time T3 for the section of the web to travel from sensor 732 to printhead array 730. Based on this information, as well as the calculated offsets described above, controller 750 implements "lag time" adjustments to printhead array 730 to ensure that its offset matches the offset of printhead array 720 for a given section of web.

Specifically, controller 750, upon calculating the value d2 at sensor 722, determines a time that it will take for the measured section of the web to reach printhead 730 (T1+T2+T3). This is the time at which printhead 730 should be aligned to match the detected offset. When time T1+T2 is reached, the section has reached sensor 732, and the current offset d4 of printhead array 730 is determined by controller 750 as described above. Then, over the period T3, controller 750 directs a linear actuator (which includes shaft 734 and motor 736) to drive printhead array 730 a distance (d4−d2) in order to align printhead array 730 to the offset found in printhead array 720. That is, printhead array 730 is shifted in lateral position by an amount Δ1+Δ2 to match the offset of printhead array 720. Each of the color planes in the downstream printer (not shown) use similar systems to laterally align themselves to printhead array 720.

Figure 8:
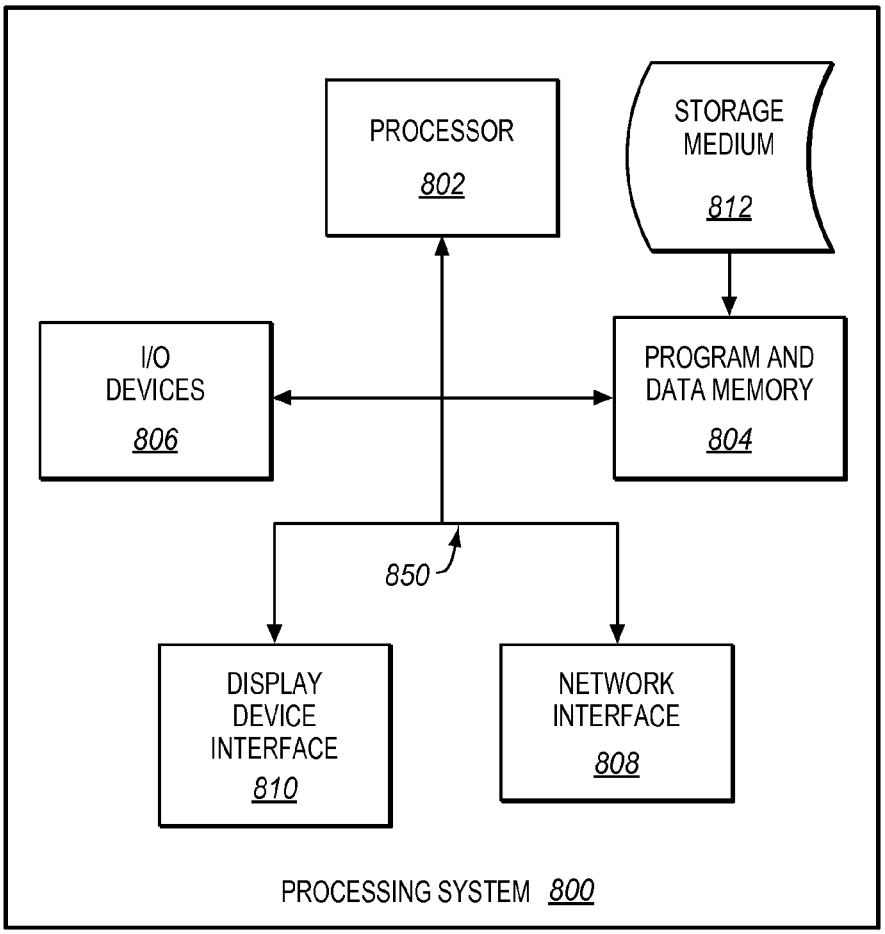
FIG. 8 illustrates a processing system operable to execute a computer readable medium embodying programmed instructions to perform desired functions in an exemplary embodiment.

Embodiments disclosed herein may take the form of software, hardware, firmware, or various combinations thereof. In one particular embodiment, software is used to direct a processing system of controller 420 to perform the various operations disclosed herein. FIG. 8 illustrates a processing system 800 operable to execute a computer readable medium embodying programmed instructions to perform desired functions in an exemplary embodiment. Processing system 800 is operable to perform the above operations by executing programmed instructions tangibly embodied on computer readable storage medium 812. In this regard, embodiments of the invention may take the form of a computer program accessible via computer-readable medium 812 providing program code for use by a computer or any other instruction execution system. For the purposes of this description, computer readable storage medium 812 may be anything that may contain or store the program for use by the computer.

Computer readable storage medium 812 may be an electronic, magnetic, optical, electromagnetic, infrared, or semiconductor device. Examples of computer readable storage medium 812 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 800, being suitable for storing and/or executing the program code, includes at least one processor 802 coupled to program and data memory 804 through a system bus 850. Program and data memory 804 may include local memory employed during actual execution of the program code, bulk storage, and cache memories that provide temporary storage of at least some program code and/or data in order to reduce the number of times the code and/or data are retrieved from bulk storage during execution.

Input/output or I/O devices 806 (including but not limited to keyboards, displays, pointing devices, etc.) may be coupled either directly or through intervening I/O controllers. Network adapter interfaces 808 may also be integrated with the system to enable processing system 800 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 810 may be integrated with the system to interface to one or more display devices, such as printing systems and screens for presentation of data generated by processor 802.

Although specific embodiments were described herein, the scope of the invention is not limited to those specific embodiments. The scope of the invention is defined by the following claims and any equivalents thereof.

We claim:

1. An apparatus comprising:

a printhead alignment system for a continuous-forms printing system, the printhead alignment system comprising:

a first sensor configured to detect lateral positions of an upstream printhead relative to sections of a web of print media traveling through the printing system;

a second sensor configured to detect lateral positions of a downstream printhead relative to the sections of the web, wherein the downstream printhead is placed after the upstream printhead in the direction of travel of the web; and a controller configured to align the downstream printhead with the sections of the web based on the lateral positions of the upstream printhead and the lateral positions of the downstream printhead.

2. The apparatus of claim 1, wherein:

the controller is configured to determine a lateral position of the upstream printhead relative to a section of the web, to determine when the section of the web will travel from the upstream printhead to the downstream printhead, and to align the downstream printhead with the lateral position by the time the section of web reaches the downstream printhead.

3. The apparatus of claim 1, wherein:

the controller is configured to apply a low pass filter to input from the first sensor indicating a stream of lateral positions detected by the first sensor, and to align the downstream printhead based on the filtered stream of lateral positions.

4. The apparatus of claim 1, wherein:

the controller is configured to identify a point in time to align the downstream printhead with a section of the web based on a distance between the upstream printhead and the downstream printhead.

5. The apparatus of claim 1, wherein:

the controller is configured to identify a point in time to align the downstream printhead with a section of the web based on a speed of the web.

6. The apparatus of claim 1, wherein:

the controller is configured to align the downstream printhead with a section of the web by moving the downstream printhead to a lateral position of the upstream printhead relative to the section of the web.

7. The apparatus of claim 1, wherein:

the controller is configured to limit a velocity for the downstream printhead while aligning the downstream printhead.

8. The apparatus of claim 1, wherein:

the controller is configured to limit an acceleration for the downstream printhead while aligning the downstream printhead.

9. The apparatus of claim 1, wherein:

the first sensor is configured to detect lateral positions of the upstream printhead based on marks applied by the upstream printhead onto the web.

10. The apparatus of claim 1, wherein:

a linear actuator repositions the downstream printhead based on input from the controller, and the controller is configured to determine discrepancies between input directing the linear actuator to move the downstream printhead a distance and actual motion of the downstream printhead, and to adjust the input from the controller based on the discrepancies.

11. A method comprising:

detecting lateral positions of an upstream printhead relative to sections of a web of print media traveling through a continuous-forms printing system, wherein a downstream printhead is placed after the upstream printhead in the direction of travel of the web;

detecting lateral positions of the downstream printhead relative to the sections of the web; and aligning the downstream printhead with the sections of the web based on the lateral positions of the upstream printhead and the lateral positions of the downstream printhead.

12. The method of claim 11, further comprising:

determining a lateral position of the upstream printhead relative to a section of the web;

determining when the section of the web will travel from the upstream printhead to the downstream printhead; and aligning the downstream printhead with the lateral position by the time the section of web reaches the downstream printhead.

13. The method of claim 11, further comprising:

applying a low pass filter to input indicating a stream of detected lateral positions of the upstream printhead; and aligning the downstream printhead based on the filtered stream of lateral positions.

14. The method of claim 11, further comprising:

identifying a point in time to align the downstream printhead with a section of the web based on a distance between the upstream printhead and the downstream printhead.

15. The method of claim 11, further comprising:

identifying a point in time to align the downstream printhead with a section of the web based on a speed of the web.

16. The method of claim 11, wherein:

aligning the downstream printhead with a section of the web comprises moving the downstream printhead to a lateral position of the upstream printhead relative to the section of the web.

17. The method of claim 11, further comprising:

limiting a velocity for the downstream printhead while aligning the downstream printhead.

18. The method of claim 11, further comprising:

limiting an acceleration for the downstream printhead while aligning the downstream printhead.

19. The method of claim 11, wherein:

lateral positions of the upstream printhead are indicated by marks applied by the upstream printhead onto the web.

20. The method of claim 11, wherein:

aligning the downstream printhead comprises providing input to a linear actuator to reposition the downstream printhead, and the method further comprises:

determining discrepancies between input directing the linear actuator to move the downstream printhead a distance and actual motion of the downstream printhead; and adjusting the input from the controller based on the discrepancies.

21. A non-transitory computer readable medium embodying programmed instructions which, when executed by a processor, are operable for performing a method comprising:

detecting lateral positions of an upstream printhead relative to sections of a web of print media traveling through a continuous-forms printing system, wherein a downstream printhead is placed after the upstream printhead in the direction of travel of the web;

detecting lateral positions of the downstream printhead relative to the sections of the web; and aligning the downstream printhead with the sections of the web based on the lateral positions of the upstream printhead and the lateral positions of the downstream printhead.

22. The medium of claim 21, wherein the method further comprises:

determining a lateral position of the upstream printhead relative to a section of the web;

determining when the section of the web will travel from the upstream printhead to the downstream printhead; and aligning the downstream printhead with the lateral position by the time the section of web reaches the downstream printhead.

23. The medium of claim 21, further comprising:

applying a low pass filter to input indicating a stream of detected lateral positions of the upstream printhead; and aligning the downstream printhead based on the filtered stream of lateral positions.

24. The medium of claim 21, wherein the method further comprises:

identifying a point in time to align the downstream printhead with a section of the web based on a distance between the upstream printhead and the downstream printhead.

25. The medium of claim 21, wherein the method further comprises:

identifying a point in time to align the downstream printhead with a section of the web based on a speed of the web.

26. The medium of claim 21, wherein:

aligning the downstream printhead with a section of the web comprises moving the downstream printhead to a lateral position of the upstream printhead relative to the section of the web.

27. The medium of claim 21, wherein the method further comprises:

limiting a velocity for the downstream printhead while aligning the downstream printhead.

28. The medium of claim 21, wherein the method further comprises:

limiting an acceleration for the downstream printhead while aligning the downstream printhead.

29. The medium of claim 21, wherein:

lateral positions of the upstream printhead are indicated by marks applied by the upstream printhead onto the web.

30. The medium of claim 21, wherein:

aligning the downstream printhead comprises providing input to a linear actuator to reposition the downstream printhead, and the method further comprises:

determining discrepancies between input directing the linear actuator to move the downstream printhead a distance and actual motion of the downstream printhead; and adjusting the input from the controller based on the discrepancies.

* * * * *